United States Patent [19]

Bird

[11] Patent Number: 4,841,903

[45] Date of Patent: Jun. 27, 1989

[54] COATING AND PRINTING APPARATUS INCLUDING AN INTERSTATION DRYER

[75] Inventor: John W. Bird, Westport, Conn.

[73] Assignee: Birow, Inc., Westport, Conn.

[21] Appl. No.: 65,914

[22] Filed: Jun. 24, 1987

[51] Int. Cl.[4] ..... B05C 11/00

[52] U.S. Cl. ..... 118/46; 101/201; 101/217; 118/66; 118/258; 118/262; 118/264; 118/602; 427/258; 427/382; 427/411

[58] Field of Search ..... 118/46, 66, 602, 258, 118/264, 262; 101/201, 217; 427/382, 258, 411

[56] References Cited

U.S. PATENT DOCUMENTS 2,288,617 7/1942 Friden ..... 118/46

3,121,642 2/1964 Biskup ..... 118/46 X

*Primary Examiner*—Bernard Pianalto

*Attorney, Agent, or Firm*—Perman & Green

[57] ABSTRACT

An offset lithographic printing method and machine having a plurality of in-line liquid application stations, at least one of which is an ink image-printing station for printing lithographic ink images on a suitable receptive copy sheet, and at least the final downstream liquid-application station is a coating application station for printing a protective, and/or aesthetic coating over selected portions of, or over the entire ink image-printed surface of the copy sheet. The present method and apparatus involves the placement of a drying station between liquid application stations to evaporate volatile solvent or vehicle from the ink images and/or to solidify the liquid coating applied at upstream stations before the application of a continuous or spot coating thereover at the next downstream coating station.

5 Claims, 1 Drawing Sheet

COATING AND PRINTING APPARATUS INCLUDING AN INTERSTATION DRYER

BACKGROUND OF THE INVENTION

Conventional lithographic offset printing machines or presses comprise one or more image-printing stations each having a plate cylinder to which is fastened a thin hydrophilic, oleophobic printing plate having image areas which are oleophilic and hydroprobic and background areas which are oleophobic and hydrophilic. The plate surface is continuously wetted with aqueous damping solution, which adheres only to the background areas, and is then inked with oleoresinous ink composition which adheres only to the image areas of the plate as wet ink. The ink is offset-transferred to the rubber surface of a contacting blanket cylinder, and then retransferred to the receptive surface of a copy web or a succession of copy sheets, such as of paper, where the ink gradually hardens or cures by oxidation after passing through a final drying station located downstream of the final liquid application station where the volatile solvent is evaporated from the ink composition of the images.

Since image-curing is gradual, it is conventional to spray the printed copies with starch or other "stilting" powder before the copies are stacked. This prevents sticking of the uncured ink images to adjacent copies and also permits the circulation of air for the oxidation-curing process.

In cases where cost is not a factor and/or where the aesthetic advantages of a protective supercoating are desired, it is known to provide the printing machine with a downstream coating station having a blanket cylinder associated with a coating application unit for the application of an overall protective coating over the entire printed area of the copy sheets or web.

This also avoids the necessity of powdering the printed images. Reference is made to U.S. Pat. No. 4,270,483 for its disclosure of such an apparatus. The coating unit of U.S. Pat. No. 4,270,483 is pivotally-associated with the blanket cylinder for movement between coating and non-coating or retracted positions. Reference is also made to my copending U.S. patent application, Serial No. 65,954, filed on even date herewith.

Protective coating compositions also improve the appearance of printed documents, particularly high quality, multi-color copies such as posters, product brochures, etc., by providing glossy or matte finishes over the entire image-printed surface or over selected image-printed portions thereof such as photographs, product illustrations, etc. Selected area coating, spot coating or perfect registration over predetermined limited printed areas of the copies is advantageous from a cost standpoint since the coating compositions are relatively expensive and the volume required is reduced if the coating is only printed in registration where desired. Also, spot coating is frequently used as a means for highlighting certain portions of the printed copies such as company name or logo, product illustrations, photographs, etc.

While the in-line application of a protective or aesthetic coating over the offset-printed images on a succession of copy sheets will prevent the dried but uncured printed images from sticking to adjacent copy sheets, the relatively wet condition of the printing ink composition and its solvent and/or diluent content, at the time that the coating composition is applied thereover, and the presence of water from the dampening system in the copy sheets, produces a visible change in the appearance of the portions of the coating overlying the printed images during the evaporation of the solvent, diluent, water, etc., whereby, for example, a glossy-surfaced protective coating acquires a flat, matte or non-glossy surface, particularly in areas overlying the dried and cured printed images, and even the affected areas are not uniform in appearance depending upon the colors and/or surface areas of the underlying printed images. For example, printed colored photographs, half-tone illustrations, and the like, which are intended to be emphasized or heightened in appearance, such as by the application of glossy spot coatings thereover, undergo loss or degradation in the uniformity of their appearance and their color during the drying of the copy sheets.

Also, in cases where the protective or aesthetic coating is only spot-applied, such as over printed photographs, product illustrations, etc., the images printed on other surface areas of the copy sheets remain exposed and can stick to adjacent copy sheets unless stilting powder is applied, as discussed herein before.

The speed of operation of conventional offset printing and coating machines makes it impossible to apply successive continuous and spot coatings to a succession of copy sheets because the second coating will not adhere properly to the first coating while the latter is still wet, and/or the second coating will undergo degradation or loss of gloss during drying of the underlying coating.

These defects are of substantial importance in cases where the additional expense of one or more coatings is justified by the desired results, i.e., promotional posters, artwork, product containers, record jackets, videocassette boxes, etc. The defects, i.e., uneven surface appearance of the coating(s), detract from the appearance of the underlying images or photographs, particularly in the case of multi-colored images or photographs and are due to the presence of residual volatile solvents, diluents, water, etc., within the oleoresinous inks of the images or photographs, and the presence of water in the copy sheets, at the time that the first coating is applied thereover, and/or to the presence of volatile solvents, diluents or water within the first coating or undercoating at the time that the second coating is applied thereover. The application of a top coating over the printed images and/or over a first coating retards the volatile solvent, diluent or water against escape in the final drying station, but it eventually migrates into the top coating during the final drying and gradual curing of the ink images over a period of several hours time, resulting in a loss of perfection in the surface finish of the top coating.

SUMMARY OF THE INVENTION

It is an object of the present invention to provide a novel printing and coating method and apparatus for the in-line application of one or more protective or aesthetic coatings over imaged subject matter offset-printed onto each of a succession of copy sheets while avoiding the usual degradation or loss of uniformity of the surface appearance of areas of the coating(s) applied over the printed images and/or over underlying coated areas.

It is another objective of the present invention to enable the in-line application of a second protective or aesthetic coating, such as a glossy-finish spot coating, over a first protective coating, such as a continuous matte-finish coating, while avoiding the problems of poor adhesion and degradation or loss of glossy surface appearance of the second coating.

Essentially, the present invention is concerned with providing unblemished coated lithographic copies of the types desired in cases where the additional expense of supercoatings is justified by the desired results.

The present method and apparatus provides for the in-line drying of lithographic ink images, including photographic multi-color reproductions, and/or the drying of first continuous or spot coatings, printed or applied at one liquid application station before the application of a continuous or spot coating over said ink images or over said continuous spot coating at the next downstream liquid application station by interposing an in-line drying station between said one and next liquid application stations in order to more completely dry the ink images or first coating prior to the application of a final coating thereover, whereby the eventual drying of said final coating results in a substantially perfect surface finish The oleoresinous inks conventionally used to print lithographic copies generally comprise a mixture of oxidizable drying oils, such as safflower oil or linseed oil, a compatible resin binder material, such as a phenolic resin or a varnish, pigment such as carbon black, drying agents, and a volatile solvent such as mineral spirits, or other solvent for the resin and oil. The printed copy sheets also contain some water from the dampening system. Drying of the images occurs in two stages, namely evaporation of the volatile solvent in the first stage to form the relatively dry, tacky printed images, and oxidation-curing of the oleoresinous printed composition which requires several hours time and results in the final non-sticky, smear-resistant printed images. The present invention is concerned with first-stage drying or solvent/water evaporation prior to the application of a supercoating over the printed images The coating compositions conventionally-used to apply protective or aesthetic coatings over printed lithographic images are aqueous solutions, dispersions or emulsions of water-dispersible or water-soluble film-forming binder materials, such as acrylic resins, hydrophilic colloids, vinyl alcohol, etc. Also, coating compositions free of volatile solvents or vehicles are commonly used, such as resin precursor compositions which are polymerizable or curable by exposure to ultraviolet or other radiation. Such compositions are based upon liquid acrylic monomers or pre-polymers, or photopolymers and photoinitiators, cross-linking agents and/or other conventional ingredients. Both solvent-applied and solvent-free coating compositions can produce microporous coatings which are permeable to oxygen to hasten the curing of the oleoresinous inks. While they are also permeable to the volatile ink solvents, diluents and water, the escape of these volatiles mars the appearance of the surface finish of the coatings, as discussed supra.

The second problem, pertinent to the embodiment of drying between coating stations, relates to the reduced receptivity of wet undercoatings for supercoatings applied thereover, producing uneven, discontinuous or spotty supercoatings having "holidays" or areas which have not accepted the supercoating.

The novel method and apparatus of the present invention overcomes these problems by drying the ink-imaged and/or undercoated copy sheets prior to the application of the undercoating over the ink-printed images and/or prior to the application of the supercoating over the undercoating, whereby substantially-perfect coatings having excellent surface properties, such as gloss, are produced.

DETAILED DESCRIPTION OF THE DRAWING

Figure 1:
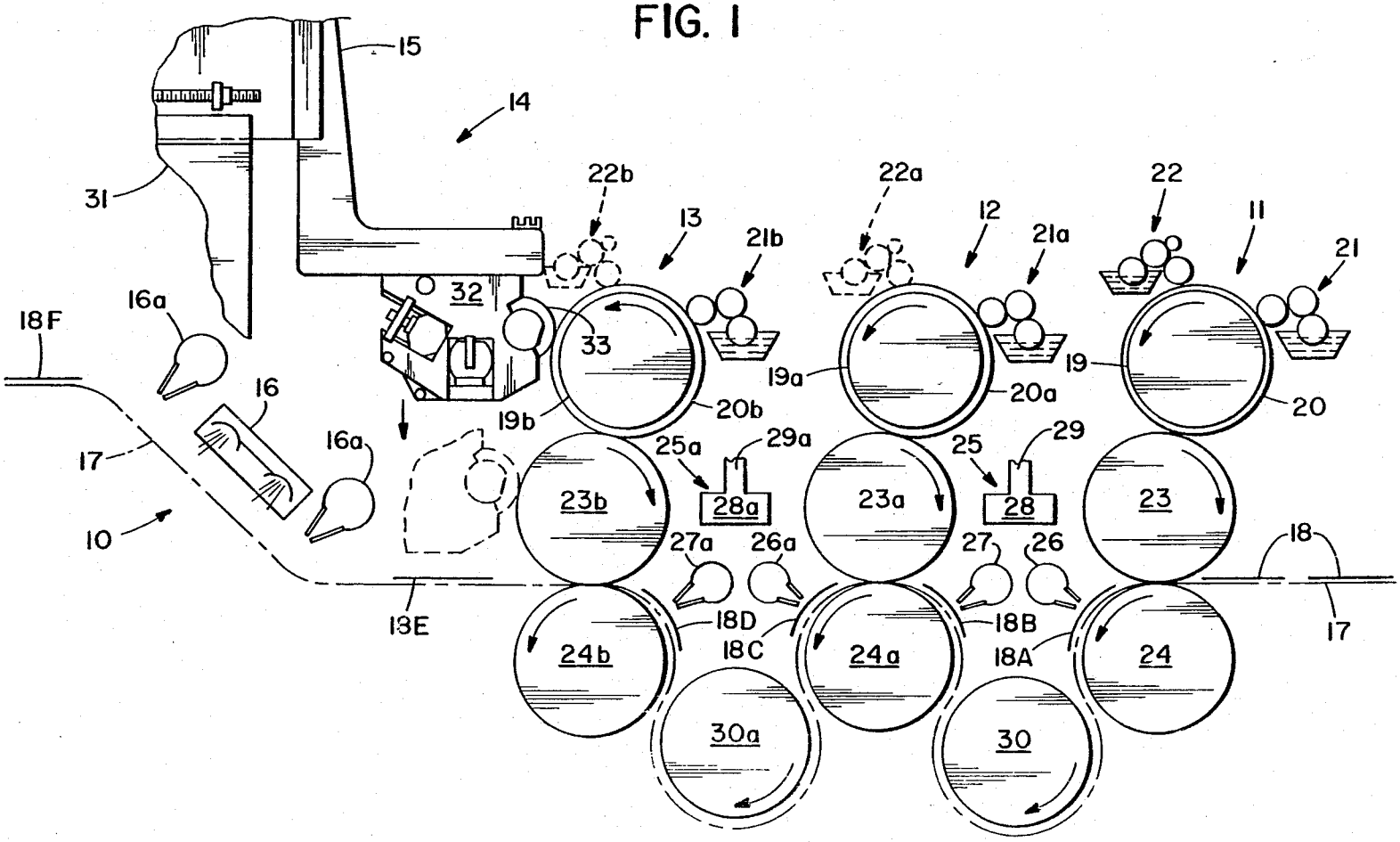
FIG. 1 is a vertical cross-sectional view, through the final three liquid application stations of an offset printing machine, illustrating the interposition of in-line drying stations between the last two liquid application stations and a final downstream liquid application station which is a coating-application station.

Referring to the drawing, FIG. 1 illustrates a downstream portion of an offset printing machine 10 comprising three liquid application stations 11, 12 and 13, a coating apparatus 14 according to aforementioned copending application Serial No. 65,954 filed June 24, 1987, comprising a coating carriage 15, a final radiation drying station 16 including air knives 16*a*, and a continuous copy sheet conveyor means 17 which moves a succession of copy sheets 18 through the printing machine.

The first liquid application station 11 is a conventional offset image printing station comprising a plate cylinder 19, to which is clamped an imaged lithographic printing plate 20 carrying oleophilic image areas, such as words, photographs, etc. on an oleophobic, hydrophilic background. The conventional clamping means permits some degree of lateral or axial adjustment and some degree of wrap-around or circumferential adjustment of the plate 20 relative to the plate cylinder 19. Plate cylinder 19 is associated with a dampening system 21 for wetting the entire hydrophilic background surface of plate 20 with aqueous dampening fluid, and with an inking system 22 for selectively inking the image areas of the plate 20 with liquid oleoresinous ink composition containing a volatile organic solvent The inked plate 20 is rotated against the ink-receptive surface of a blanket cylinder 23, to which the wet ink images are offset or transferred, and the blanket cylinder 23 is rotated against a copy sheet 18, passed in the nip between the blanket cylinder 23 and an impression cylinder 24, to transfer the wet ink images to the copy sheet 18 and form an image-printed copy sheet 18A. Some water from the dampening system is also transferred to the surface of the copy sheet 18A. Sheet 18A is conveyed, imaged face up, through a 25 first drying interstation 25, comprising a pair of spaced, elongate air knives 26 and 27 and a vapor-extraction unit 28 containing an intake fan and a outlet conduit 29 which conveys the volatile vehicle vapors to a recovery unit, to the atmosphere or for 30 other safe disposal.

As illustrated, the printed copy sheets 18A, are conveyed by grippers past the first air knife 26, under transfer cylinder 30 and past the second air knife 27, to form dried printed copy sheets 18B which move into the next liquid application station 12.

The air knives 26 and 27 and the extraction unit 28 are conventional elements normally used as final drying elements on printing and coating machines of different types. Knives 26 and 27 are elongate tubular elements provided with an elongate narrow slot formed by opposed, converging walls. Heated air is circulated through the tubular elements under pressure and is expelled from the elongate slot as a concentrated narrow band of high speed hot air which is directed against the ink-printed copy sheets 18A to evaporate the volatile solvent and water therefrom to release solvent and water vapor which is withdrawn by the extraction unit 28. Substantial drying is produced by the first air knife 26, and the second air knife 27 preferrably is included, as illustrated, to insure complete drying prior to the entry of the copy sheets 18B to the next liquid application station.

In the apparatus of FIG. 1, the second liquid application station 12 can be either another ink printing station, such as for printing ink of a second color, or it can be a first coating station Thus the various elements of station 12 are numbered similarly to those of station 11 but including the suffix a.

Where station 12 is another ink printing station, the first drying interstation 25, upstream therefrom, functions only as a supplemental drying station and can be excluded or disconnected.

Where station 12 is a first coating application station, the first drying interstation 25 is a critical component of the present invention. In such case, the inking system **22*a* of station 12 is withdrawn, as shown by means of broken lines, and the dampening system 21*a*** is converted to a dampener coater system by providing a continuous supply of the desired coating composition to the supply pan thereof, i.e., an aqueous dispersion of a film-forming binder material containing in the case of matte-finish coatings, a diffusion filler such as silica or the like.

Generally, where the station 12 is a first coating station, the top roll **19*a* will be a plate cylinder having a full plate 20*a* for the application of continuous coatings to the intermediate blanket cylinder 23*a* or transfer cylinder and then to the dried ink-printed copy sheets 18B to form continuous coated printed copy sheets 18*c*. However, if desired, plate cylinder 19*a* may have a spot-receptive plate or relief plate 20*a* for the transfer of spot coatings to the intermediate blanket cylinder 23*a* and then to predetermined areas of the printed copy sheets 18B to form spot-coated printed copy sheets 18C**.

Most commonly, the first coating will be a complete or continuous coating of a composition providing a matte non-glossy finish or a utility (semi-gloss) finish, and the second coating will be a spot coating of a composition providing a glossy finish to highlight predetermined areas of the printed, coated copies.

The coated printed copy sheets 18C exiting the first coating station 12 are conveyed by grippers, coated side up, through the second drying interstation **25*a*which is similar to the first drying station 25 and comprises a similar pair of spaced elongate air knives 26*a* and 27*a* and a similar extraction unit 28*a* and exhaust outlet conduit 29*a***.

The line of forced hot air from the first knife **26*a*, across the width of the copy sheets, substantially dries the first coating by evaporating the water vehicle therefrom, after which the dried, coated copy sheets 19D are conveyed by transfer roll 30*a* to the second air knife 27*a* to insure complete drying of the first coating prior to the entry of the coated printed copy sheets 18D into the final coating station 13** which includes the coating-application apparatus of the copending application, in the illustrated embodiment, but which may be a conventional coating station.

In cases where the first and/or second coating composition is free of volatiles and solidifies by polymerization curing, the drying interstation **25*a* and/or downstream drying station 16** will contain a suitable radiation source such as ultraviolet lamps.

The coating application station 13 also can be similar to the inking station 11 and first coating station 12 with respect to the plate cylinder **19*b* supporting a printing plate dampening system 21*b*, inking system 22*b*, blanket cylinder 23*b* and impression cylinder 24*b* since, in a conventional offset printing machine having a plurality of liquid application stations, all of the stations are generally similar but use different printing plates to image different areas of the same copy sheet with different colored inks. The present apparatus, requiring at least one coating-application station, and modifies at least the final downstream inking station to convert it permanently or intermittently to a coating-application station as shown by FIG. 1** or, alternatively, as illustrated by U.S. Pat. No. 4,270,483 discussed hereinbefore.

Plate **20*b* is an offset relief printing plate, preselected areas of which are raised above the background, generally referred to as "relief spots" Such spots are sized and positioned to correspond to areas of the image-printed copy sheets 18D** which it is desired to selectively coat.

The adjustable coating apparatus 14 is mounted onto the frame 31 of the printing machine for extension of the coating carriage 15 into the liquid application station 13 for adjustable coating association with either the coating plate cylinder **19*b* or the coating blanket cylinder 23*b***, as desired.

The preferred coating application apparatus 14 includes a coating carriage 15 which is horizontally adjustably, in the machine direction, for movement between retracted or passive position and extended or active position, and also vertically adjustable for movement between the levels of the plate cylinder and the blanket cylinder as shown by means of broken lines. Moreover, the coating carriage 15 comprises a horizontally-adjustable coating applicator unit 32 which is movable in the machine direction between different extended coating positions to move the coating applicator roll 33 into coating association with printing and blanket cylinders which are not in vertical alignment, as disclosed in detail in my aforementioned copending application.

Thus, the coating carriage 15 and the applicator unit 32 are adjusted in the final coating station 13 to associate applicator roll 33 with either the spot relief plate **20*b* on printing roll 19*b*, for the printing of spot coatings, or with the blanket roll 23*b*, for the application of continuous coatings onto the dried, coated, printed copy sheets 18D, to form double-coated printed copies 18E. Copies 18E are transported by grippers past a final downstream radiant dryer 16 and air knives 16*a*, to evaporate the water vehicle from the second coating and form final copies 18F** which are stacked to permit final curing of the oleoresinous printing ink.

The essential novelty of the present invention resides in the interposition of a drying station, such as 25 and **25*a***, between an ink printing station and a coating station, and preferably also between coating stations on machines having a plurality of coating stations, in order to substantially completely evaporate the volatile solvent or vehicle from the printed ink images, and evaporate any residual dampening water from the printed copy sheets, before the application of a spot or continuous coating thereover, and preferably to substantially completely solidify and dry the first coating such as by irradiating to polymerize or by evaporating the volatile solvent, vehicle and/or water from the coated, printed copy sheets before the in-line application of a second spot or continuous coating over the first-applied coating, as illustrated.

In operation, a succession of copy sheets 18 is automatically gripped by the conveyor means 17 and transported through one or more ink printing stations 11 into printing contact with one or more ink blanket rolls 23 to print images, such as of different colors, on predetermined areas of each copy sheet, using conventional oleoresinous inks containing volatile organic solvent(s). At each ink-printing station 11, an offset printing plate 20 is fastened to a plate cylinder 19, moistened with water/chemical dampening fluid by means of dampening unit 21 and inked by means of inking unit 22. The ink is selectively received by the image areas of the plate 20, where some water dampening solution is picked up by the ink, transferred to the surface of the blanket cylinder 23 and re-transferred to the upper surface of a copy sheet 18 passed in the nip of cylinder 23 and impression cylinder 24. At this point, the ink images on each imaged copy sheet 18A still contain the volatile organic solvent and some water dampening solution which migrates into the copy paper.

Rather than moving the inked copy sheets 18A directly from a printing station 11 to a coating station 12, as is conventional in the art, the present method and apparatus provides for intermediate or interstation drying of the inked copies to evaporate the volatile organic solvent and water dampening solution from the ink images and copy paper to form solvent-free copies 18B prior to the application of a protective and/or aesthetic coating thereover.

In the embodiment of FIG. 1 the ink-printed copies 18A are moved through an interstation drying station 25 by directing the path of the copy sheets down under a transfer cylinder 30 and up over the coating impression cylinder **24*a* of the coating station 12. The drying of the copy sheets is accomplished by one or more high velocity hot air knife drying elements, such as 26 and 27 shown in FIG. 1, which heat the ink image, sufficiently lowering the solvent vapor pressure while the high velocity air scrubs the vapor from the surface to evaporate substantially all of the volatile organic solvent and water and form substantially solvent-free copies 18B before the copies 18B pass in the coating nip at coating station 12**.

The evaporated solvent and moisture is drawn into the solvent extraction unit 28 by an exhaust fan 31 and removed from the ambient atmosphere by conduit 29 for safety purposes.

On machines having a single coating application station, such as station 12 or station 13 of FIG. 1, the solvent-free copies 18B are moved through said coating station 12 or 13 to receive either a continuous or a spot coating to form coated, printed copy sheets 18C which are transported to the final downstream drying station **16, 16*a*. On machines having two coating stations 12 and 13 used for the application to two superposed coatings, either of which may be spot or continuous, matte or glossy, the dried, printed copy sheets 18B are moved through the first coating station 12 to form coated, printed copy sheets 18C which are moved through the second interstation drying station 25*a* to form dried coated copy sheets 18D. Sheets 18D are moved through the second coating station 13 and on through the downstream drying station 16, 16*a***.

After curing for several hours, the coated, printed copies 18F are found to be free of the surface defects of copy sheets printed and coated in similar manner but in the absence of interstation drying.

While the present specification and drawing refer to a continuous copy sheet conveyor means 17 carrying automatic grippers, it will be clear to those skilled in the art that most printing and coating machines convey the copy sheets by means of automatic grippers present on each of a series of contacting cylinders, such as the impression cylinders **24, 24*a* and 24*b* and the interposed transfer cylinders 30 and 30*a* of FIG. 1**.

It is to be understood that the above described embodiments of the invention are illustrative only and that modifications throughout may occur to those skilled in the art. Accordingly, this invention is not to be regarded as limited to the embodiments disclosed herein, but is to be limited as defined by the appended claims.

What is claimed is:

1. In a continuous in-line offset lithographic printing machine for printing and coating a continuous succession of receptive copy paper sheets, comprising a plurality of liquid application stations, each comprising a plate cylinder for supporting a lithographic printing plate and including means for supplying oleous printing composition to oleophilic image areas on the water-coated surface of a said printing plate supported thereon, a blanket cylinder for receiving said printing composition and water from said plate cylinder and for transferring said printing composition and water to a succession of individual receptive copy paper sheets, and an impression cylinder forming a nip with said blanket cylinder through which said individual receptive copy paper sheets are passed to receive printing composition and water from said blanket cylinder, at least one said liquid application station being an upstream ink printing station for the transfer of printing composition in the form of ink images containing a volatile vehicle onto said succession of copy sheets, and at least one said liquid application station being a downstream coating station for the application of a printing composition in the form of a continuous or spot coating of liquid composition over the ink-imaged surface of said copy sheets, means for feeding said succession of individual receptive copy paper sheets through the nips of said blanket and impression cylinders of said liquid application stations, and a final downstream drying station for drying or otherwise solidifying said coated copy paper sheets, the improvements which comprises an intermediate in-line drying station positioned after each of said liquid application stations, each said drying station comprising means for directing forced hot air against the ink printed copy paper sheets to effect the evaporation of water and the volatile vehicle from the ink images printed on said copy paper sheets prior to the entry of the ink-imaged copy paper sheets into the next liquid application station including into said coating station.

2. A printing machine according to claim 1 having two adjacent downstream coating stations, characterized by the presence of another intermediate in-line drying station positioned in-line therebetween to effect the solidification of the coating applied at the first coating station prior to the entry of the coated copy sheets into the second coating station.

3. A printing machine according to claim 1 in which said coating station comprises a coating application assembly which is adjustably supported for coating association with either the plate cylinder, for the application of spot coatings, or the blanket cylinder, for the application of continuous coatings, to said copy sheets.

4. A printing machine according to claim 1 in which said intermediate drying station also comprises a vapor extraction means.

5. A printing machine according to claim 1 in which said means comprises an air knife.

* * * * *